US005890335A

United States Patent [19]

Fox

[11] Patent Number: 5,890,335

[45] Date of Patent: Apr. 6, 1999

[54] GLASS BLOCK PANEL CONSTRUCTION AND METHOD AND APPARATUS FOR FABRICATION THEREOF

[75] Inventor: Robert E. Fox, St. Clair Shores, Mich.

[73] Assignee: Trend Products, Inc., Warren, Mich.

[21] Appl. No.: 873,127

[22] Filed: Jun. 11, 1997

[51] Int. Cl.[6] ..... E04B 5/46

[52] U.S. Cl. ..... 52/306; 52/747.12; 52/741.1

[58] Field of Search ..... 52/306, 307, 308, 52/741.1, 741.14, 741.4, 745.02, 745.03, 747.1, 747.12

[56] References Cited

U.S. PATENT DOCUMENTS

| | | |
|---|---|---|
| 2,162,987 | 6/1939 | Winship . |
| 2,167,764 | 8/1939 | Lytle . |
| 2,232,798 | 2/1941 | Paddock . |
| 2,835,623 | 5/1958 | Vincent et al. . |
| 2,972,783 | 2/1961 | Russell et al. . |
| 3,234,699 | 2/1966 | Smith . |
| 4,058,943 | 11/1977 | Sturgill . |
| 4,774,793 | 10/1988 | Mayer . |
| 4,986,048 | 1/1991 | McMarlin . |
| 5,009,048 | 4/1991 | Paul . |
| 5,033,245 | 7/1991 | Kline . |
| 5,042,210 | 8/1991 | Taylor . |
| 5,259,161 | 11/1993 | Carter . |
| 5,367,846 | 11/1994 | von Roenn, Jr. . |
| 5,430,985 | 7/1995 | Coleman . |
| 5,448,864 | 9/1995 | Rosamond . |
| 5,485,702 | 1/1996 | Sholton . |

*Primary Examiner*—Creighton Smith
*Attorney, Agent, or Firm*—Hall, Priddy & Myers

[57] ABSTRACT

A method and apparatus for the prefabrication of glass blocks panel, and the panel formed thereby is provided. Glass blocks are spaced on a spacing rack such that upper and lower slots are formed between adjacent blocks and a joint cavity defined therebetween. A pair of moving manifolds disposed at right angles to each other communicate with the glass blocks assembled on the spacing rack to internally caulk and seal the blocks together. The moving manifolds include vertically disposed feed tube devices, each including a pair of elongated feed tubes which are in a spring-like relation. The feed tubes include an aperture disposed on opposing surfaces proximate to the distal ends for simultaneous dispensing sealant into the upper and lower slots of adjacent glass blocks and a protruding distal end portion for simultaneously compressing the sealant into the lower and upper and lower slots of adjacent glass blocks as the sealant is released. The sealant used may be silicone, or any other adhesive that adheres naturally to glass.

7 Claims, 5 Drawing Sheets

GLASS BLOCK PANEL CONSTRUCTION AND METHOD AND APPARATUS FOR FABRICATION THEREOF

FIELD OF THE INVENTION

This invention relates to panels of glass blocks and to devices and methods used in constructing such panels. More particularly, the invention relates to the construction of prefabricated glass block walls without the use of integral spacers or mortar.

BACKGROUND OF THE INVENTION

In the construction of glass block walls or panels, a significant level of skill is required to properly space and align the blocks with respect to each other. Glass block walls are typically assembled on-site by a mason, much in the same way as brick walls are assembled, with mortar spread on exposed edges of the blocks and set into place. However, glass blocks are normally placed and aligned directly above each other, without overlapping as in the construction of brick walls. When assembling glass block panels, it is essential that rather precise spatial relationships between the glass blocks be maintained in order to provide a more structurally sound and aesthetically pleasing panel.

Frequently, mortar has been used to secure the blocks to one another as exemplified in U.S. Pat. No. 2,167,764. However, there are several problems associated with the use of mortar in constructing glass block panels. For instance, the use of mortar requires a skilled mason to accurately determine the amount of mortar to be used, as well as to achieve the proper placement of the mortar in the panel. This increases the amount of time necessary to construct such a panel and requires high levels of training and experience in the work force. In this respect, if the glass blocks are laid too quickly, the weight of the block will tend to squeeze the mortar, misaligning the panel. This results in both an aesthetically displeasing and structurally unsound panel.

Another drawback in the use of mortar is the inadequate bond formed between the mortar and the glass. The mortar does not naturally adhere to the glass, and can result in a more fragile glass block panel. Mortar has essentially no elasticity, making the panel more subject to cracking. Given these drawbacks, the art has been prompted to develop mortarless glass blocks.

Mortarless glass block panels typically include the use of integral spacers interposed between the blocks. Spacers add the benefit of properly aligning the blocks without the necessity of a skilled mason. An adhesive is then applied to the spacers and adjacent blocks to bond and secure the panel. Typically, a clear silicone adhesive is used to caulk in the joints and the outer interfaces of the blocks. Silicone is known to be particularly useful in that it bonds well with glass, yet provides enough flexibility to avoid the cracking problem associated with the use of mortar.

An example of a mortarless glass block assembly is exemplified in U.S. Pat. No. 4,986,048. In that assembly, a continuous flexible spacer member is placed along the horizontal end walls, while separate flexible spacer members are placed in vertical end walls of the glass blocks. An adhesive is placed between the blocks to adhere the spacers and blocks together. The adhesive is applied by a mason who also caulks the joints from the outside. While mortarless glass block panels offer significant advantages over mortar glass block panels, there are various drawbacks associated with such panels. For instance, the rate at which the panels may be assembled is relatively slow. The panel can only be assembled as quickly as the workers lay courses of blocks. In addition, the spacers and adhesive must be applied by a mason with precision, a task which is time consuming, tedious and subject to human error.

In view of the above it is not surprising that there has been a move in the art towards the use of prefabricated glass block panels. A significant benefit to using prefabricated panels is that they are assembled in a controlled setting, where stringent quality control of the assembled panels can be maintained. An example of a prefabricated panel is exemplified in U.S. Pat. No. 5,448,864 to Rosamond. Rosamond discloses the fabrication of a glass block panel from the use of vertical and horizontal frame members for spacing the glass blocks, with the sealant interposed between the blocks and the adjacent frame members. While glass block panels assembled in accordance with the '864 patent offer advantages to the mortarless glass block panels assembled on-site, there remain various drawbacks. For instance, the presence of the spacers in the panel or wall renders it somewhat weaker than if only adhesive is present. Likewise, the costs associated with the production of the integral spacers which remain affixed in the panels and the labor cost associated with the assembly of these panels are rather undesirable. Finally, a significant level of skill is still needed to properly space, align, and place the blocks. This increases cost in terms of both time and personnel.

Accordingly, there is a need in the art for a method and device for prefabricating glass block panels without the use of mortar or integral spacers, while at the same time acquiring quality and strength of the glass block panel, as well as decreasing the time and level of human skill associated with its construction. It is a purpose of this invention to fulfill this and other needs in the art which will become more apparent to the skilled artisan once given the following disclosure.

SUMMARY OF THE INVENTION

Generally speaking, this invention fulfills the above described needs in the art by providing a method for assembling a glass block wall on a surface. A method for assembling at least two glass blocks together, includes the step of providing a spacing rack for positioning glass blocks in proper spaced alignment such that upper and lower seams are formed between upper and lower interfaces of adjacent blocks and a joint cavity is defined between the seams. The glass blocks are positioned on the spacing rack. A sealant applying means is inserted into the joint cavity. A sealant is simultaneously dispensed into the upper and lower seams through the sealant applying means. Likewise, the sealant is simultaneously compressed into the upper and lower seams as the sealant is dispensed.

The present invention fulfills further needs in the art by providing an apparatus for assembling a glass block wall on a surface. An apparatus for assembling at least two glass blocks together includes a spacing rack for positioning glass blocks in proper spaced alignment, such that upper and lower seams are formed between upper and lower interfaces of adjacent blocks and a joint cavity is defined between the seams. The apparatus also includes sealant applying means for dispensing a sealant simultaneously into the upper and lower seams, means for inserting into the joint cavity the sealant applying means, and means for compressing the sealant into the upper and lower seams simultaneously as the sealant is dispensed from the sealant applying means.

The present invention fulfills yet further needs in the art by providing a tool for internally caulking upper and lower seams formed between adjacent blocks. A tool for internally applying sealant into first and second seams formed between adjacent blocks includes a pair of elongated feed tubes having proximal and distal ends and opposing surfaces. The proximal ends include an opening for receiving the sealant. The feed tubes include an aperture disposed on the opposing surfaces proximate to the distal ends for simultaneously dispensing sealant into the upper and lower seams of adjacent glass blocks and a compacting abutment means for simultaneously compressing the sealant into the upper and lower seams of adjacent glass blocks as the sealant is released from the apertures. The feed tubes are secured by at least one rigid cross member fixedly secured and perpendicular to the longitudinal axis of the feed tubes such that when the distal ends of the feed tubes are inserted into the joint cavity, a sufficient tension is created in the compacting abutment means to compress the sealant into the upper and lower seams.

The present invention fulfills other needs in the art by providing a prefabricated glass block assembly. A prefabricated glass block panel assembly, includes a plurality of glass blocks. The glass blocks include a generally rectangular configuration with vertical and horizontal end walls and a pair of side walls. The side walls and the end walls form edge portions therebetween. The glass blocks are positioned in abutting relation to one another such that seams are formed between edge portions. The seams are filled with an adhesive which secure the blocks to one another.

The present invention fulfills yet other needs in the art by providing a tool for internally applying sealant into a seam formed between adjacent glass blocks. A tool for internally applying sealant into a seam formed between adjacent glass blocks includes a feed tube having a first member, a flared second member, and a third member. The first member and the third member are substantially parallel and are connected by the flared second member such that the third member abuts the seam formed between adjacent blocks when the tool is in use. The first member includes an opening for receiving sealant. The third member includes an aperture disposed on a surface abutting the seam for dispensing sealant into the seam and a compacting abutment means disposed at its distal end for compressing the sealant into the seam as the sealant is released from the aperture.

This invention will now be described with respect to certain embodiments thereof as illustrated in the following drawings, wherein:

DESCRIPTION OF THE DRAWINGS

Figure 1:
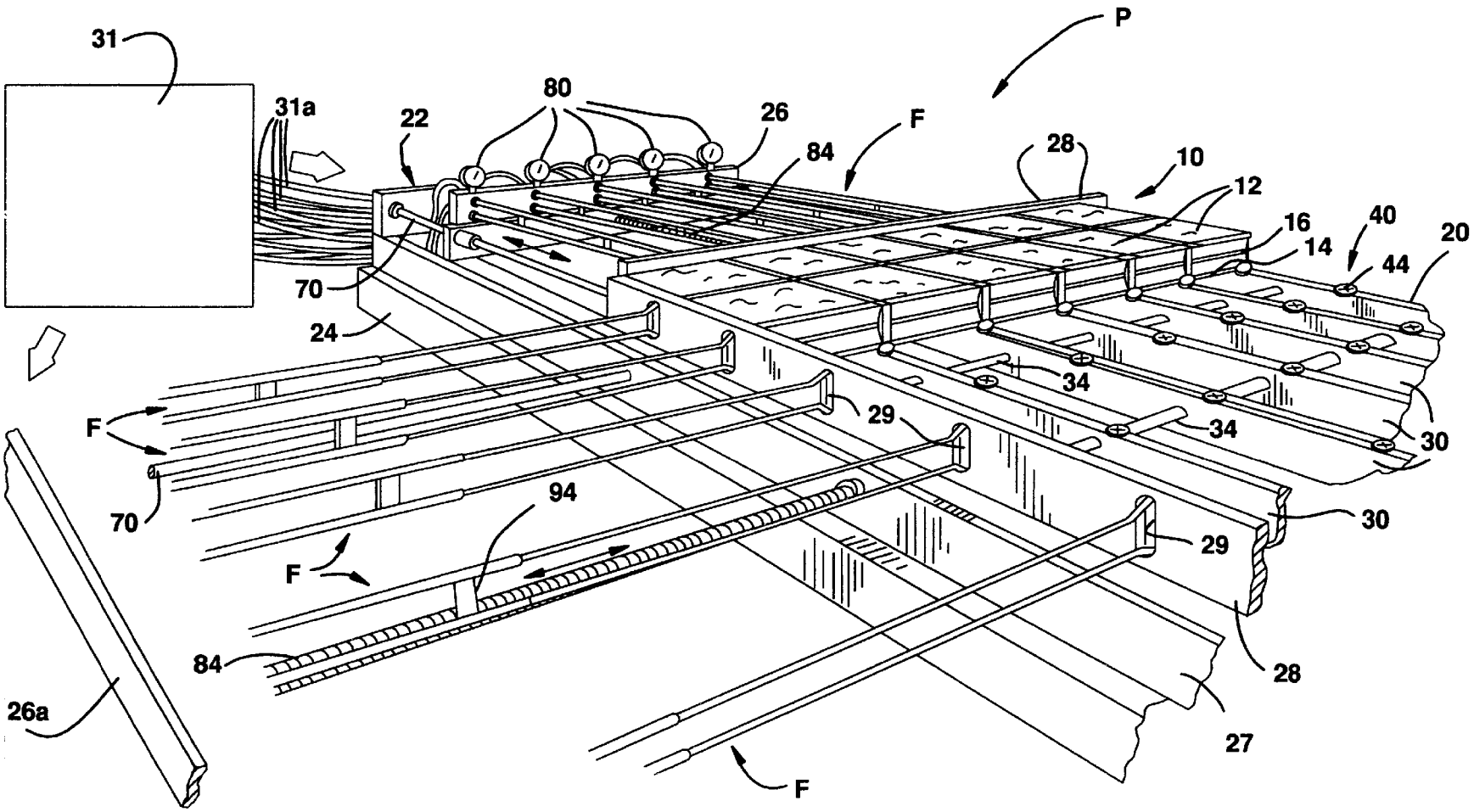
FIG. 1 is a perspective partially sectionalized view of an embodiment of a panel assembly device according to the present invention.
Figure 2:
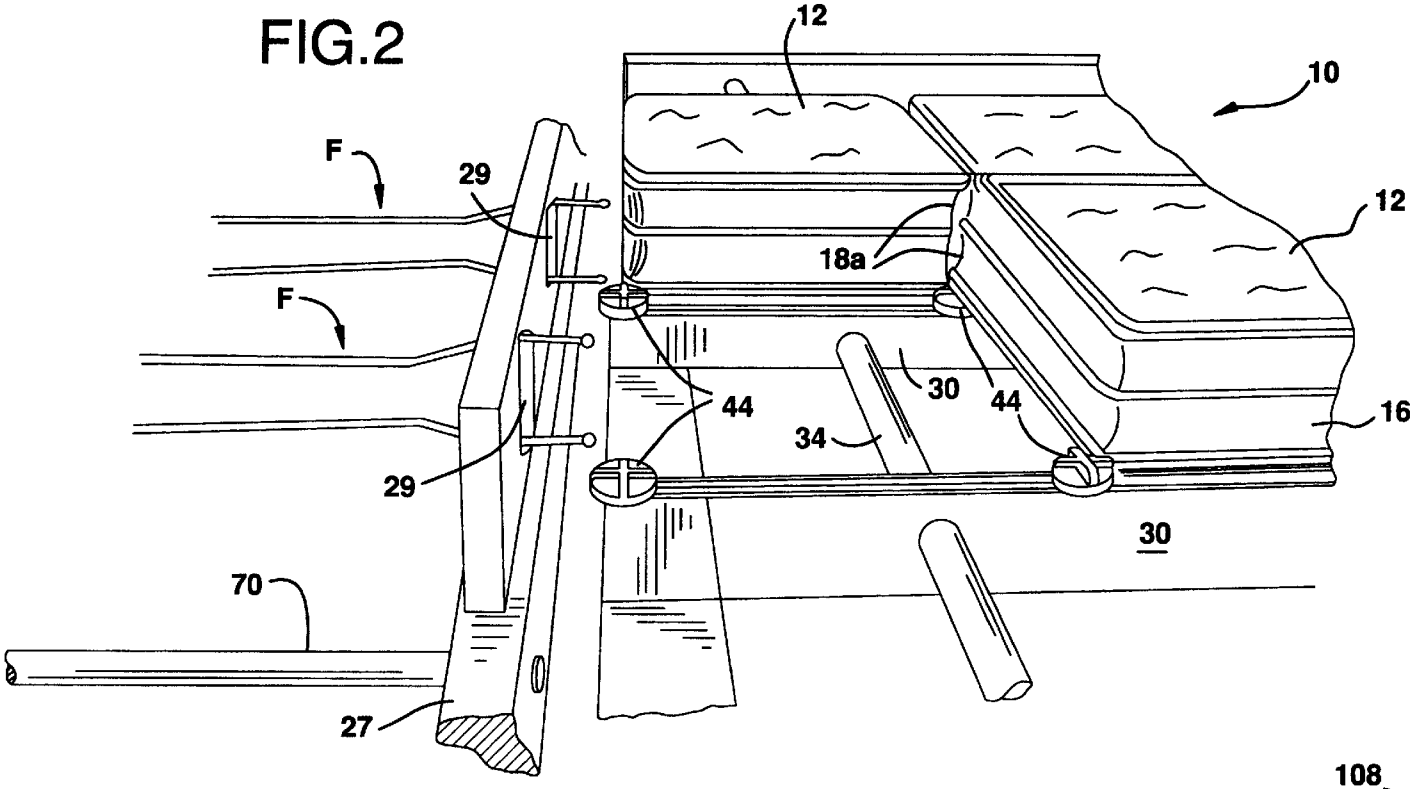
FIG. 2 is a partial, perspective, partially sectionalized view of the panel assembling device of FIG. 1.
Figure 4:
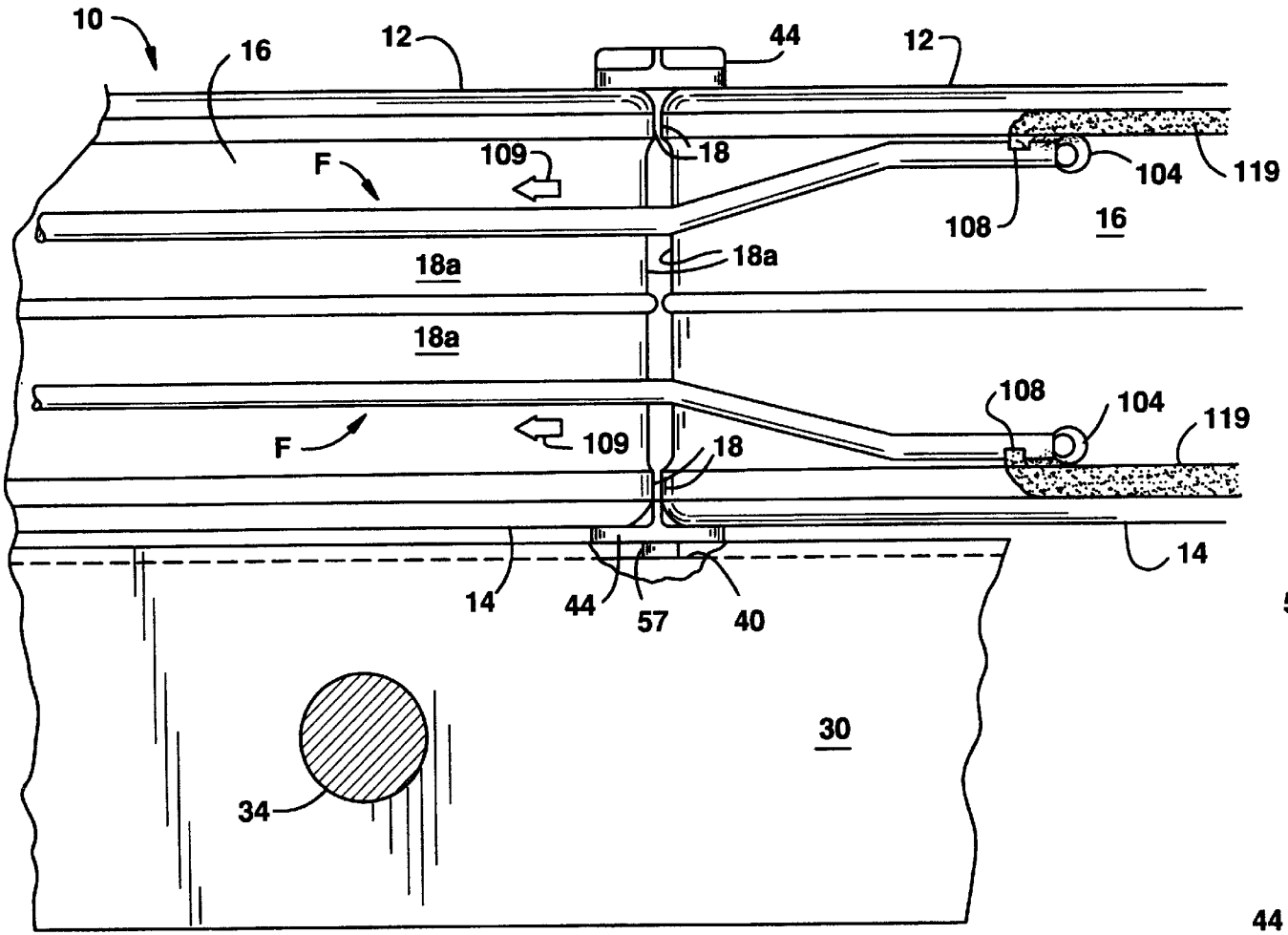
FIG. 4 is a view of glass blocks with the sealant being applied according to the present invention.

With reference to FIGS. 1, 2, and 4, there is illustrated panel assembly device P for assembling a plurality glass blocks 10 into a panel. Glass blocks 10, as illustrated herein, have a generally, three dimensional rectangular configuration. Each block 10 includes upper and lower horizontal end walls 12 and 14, respectively, and four vertical side walls 16. The side walls and end walls form raised edge portions 18 at their junctions. When blocks 10 are stacked, these raised end portions 18 result in the creation of joint cavities 18*a* being formed between adjacent blocks, the formation of these cavities 18*a* allow panel assembly device P to internally caulk and seal upper and lower adjacent edge portions 18 of glass blocks 10 when they are positioned on a surface, as described below.

Figure 6:
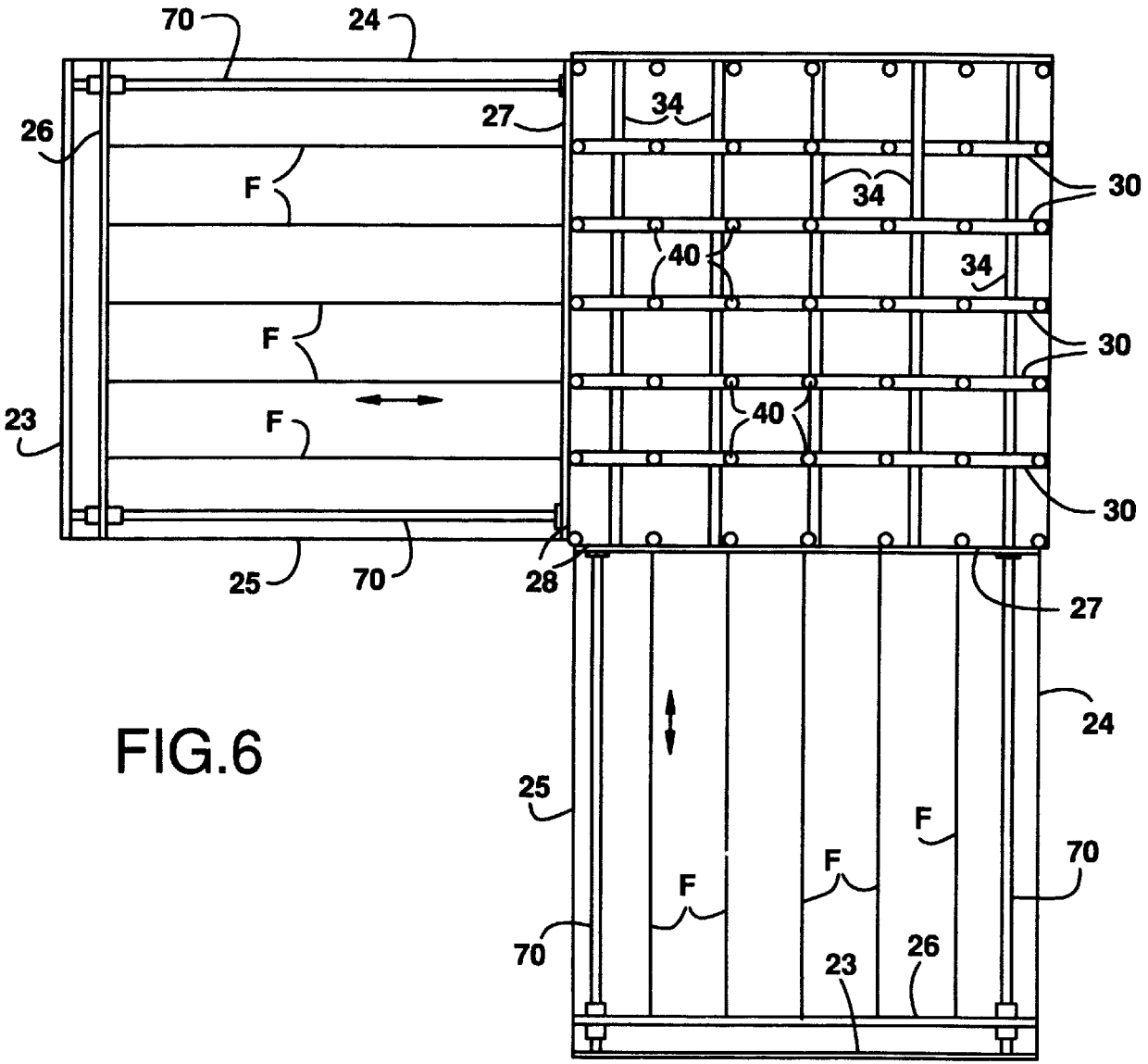
FIG. 6 is a plan view of an embodiment of a support frame used in the practice of the present invention.
Figure 7A:
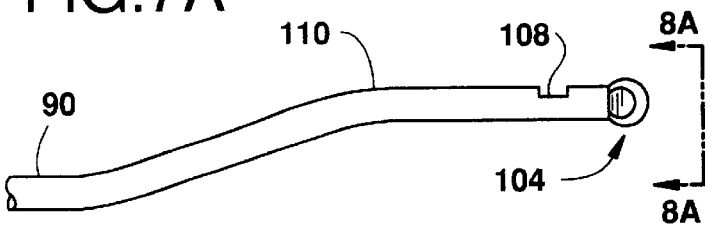
FIGS. 7(*a*)–(*e*) is a side plan view of various alternative embodiments of a feed tube device according to the present invention.
Figure 8A:
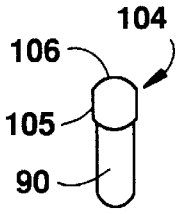
FIGS. 8(*a*)–(*e*) is a cross sectional end view of the feed tube devices of FIGS. 7(*a*)–(*e*) respectively taken along line 8—8.
Figure 7B:
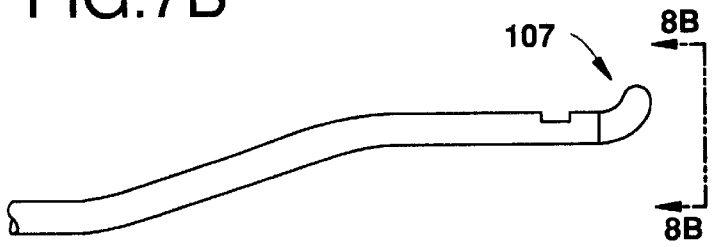
Figure 8B:
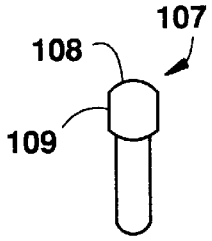
Figure 7C:
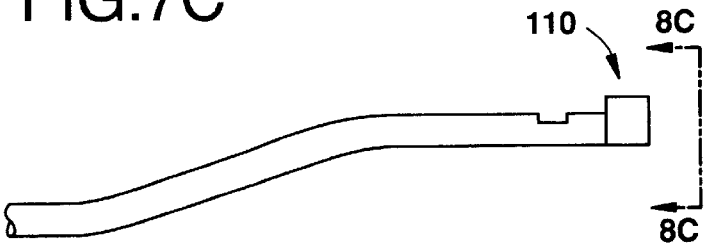
Figure 8C:
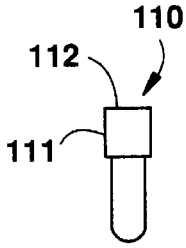
Figure 7D:
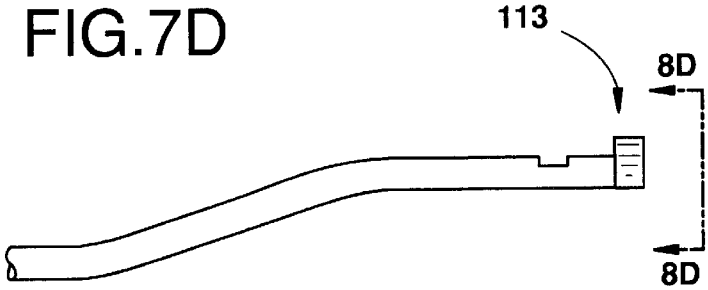
Figure 8D:
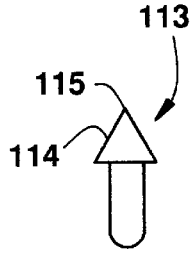
Figure 7E:
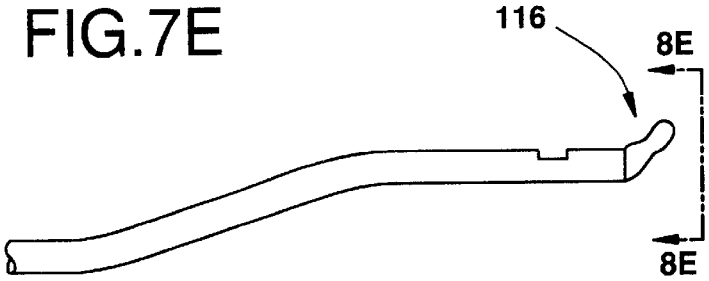
Figure 8E:
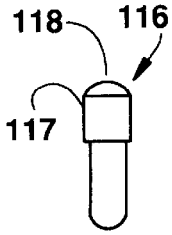

Panel assembling device P includes spacing rack 20, support frame 22, and moving manifolds 26 (only one bank being shown for convenience, the other being represented by schematic box 26*a*). It is understood that box 26*a* is, simply, a duplicate of manifold 26 which controls the adhesive process effected in the joints and cavities at right angles to those associated with manifold 26. Support frame 22 is the base of the structure and supports spacing rack 20 and moving manifold 26. While only a partial view of support frame 22 is shown in FIG. 1, an entire plan view of support frame 22 is shown in FIG. 6. With particular reference to FIG. 6, then, support frame 22 is generally L-shaped and includes two vertical end members 23, two outer vertical side members 24, and two vertical inner side members 25. Support frame 22 also includes two interfacing members 27, which are perpendicular to one another. Each interfacing member 27 is disposed between and parallel to an end member 23 and an outer side member 24.

Spacing rack 20 is positioned and defined by interfacing member 27, and is designed to receive and retain glass blocks 10 while they are assembled into a panel. Spacing rack 20 is positioned in such a manner so that the two perpendicularly disposed manifolds 26, 26*a* are able to effect the adhesive process between all interfaces of adjacent blocks 10.

Moving manifolds 26, 26*a* are carried by support frame 22. Each moving manifold 26, 26*a* is disposed between and is parallel to a vertical end member 23 and an interfacing member 27. Moving manifolds 26, 26*a* move between vertical end members 23 and spacing rack 20, to interface with and internally caulk glass blocks 10 positioned on spacing rack 20.

Each moving manifold 26, 26*a* includes a plurality of feed tube devices F attached thereon, which function to internally caulk and seal glass blocks 10. In the preferred embodiments of this invention, each moving manifold 26, 26*a* includes five feed tube devices. It is understood, however, that each manifold may include more or less feed tube devices to meet various needs. Sealant is received by manifolds 26, 26*a* from supply feed 31 via feed lines 31*a* (lines to manifold 26*a* not being shown for convenience, and being duplicates of those to manifold 26). In turn, moving manifolds, 26, 26*a* feed sealant to feed tube devices F which dispense the sealant into the internal interfaces of adjacent glass blocks at the appropriate time, as described more fully below. In order to properly caulk and seal the seams created between internal edge portions 18 of adjacent glass blocks by manifolds 26,

26*a* the glass blocks 10 must be properly spaced. This is accomplished by way of spacing rack 20.

With reference now to FIGS. 1, 2, and 6, spacing rack 20 is generally square in plan and defined by outer side members 24 and interfacing members 27. Rack 20 includes two guide bars 28 which are perpendicular to each other and disposed directly above interfacing member 27. In the preferred embodiment, guide bars 28 each include a plurality of slotted portions 29 (here, five to accommodate the five feed tubes F are associated therewith). Each slotted portion 29 interacts with a respective feed tube devices F, to position the respective feed tube device F as it is inserted into cavities 18*a* by moving manifolds 26, 26*a*.

Spacing rack 20 also includes a plurality of spacing rails 30, which support and space glass blocks 10 as they are assembled. Spacing rails 30 are secured to support frame 22 by a plurality of spaced support rods 34 which are disposed perpendicularly through spacing rails 30. Support rods 34 are equally spaced and secured between vertical side members 24 and interfacing members 27. In certain preferred embodiments of this invention, spacing rails 30 are spaced apart at a distance equal to the length of lower horizontal end wall 14 of glass blocks 10. Spacing rails 30 include machined grooves 40 along their top surface (see FIG. 2), which are also placed at distances equal to the width of lower horizontal end member 14 of glass blocks 10.

Grooves 40 are preferably rectangular in shape to receive lower rectangular stem portion 57 (FIG. 5*a*) of spacers 44 which operate to space and align opposing corners of glass blocks 10 in a manner which creates upper and lower spacing for the adhesive between adjacent upper and lower edge portions 18 of continuous blocks. Thus, grooves 40 and spacing members 30 are appropriately located so that spacers 44 provide an appropriately sized and precisely aligned space between contiguous blocks which deters sealant from leaking or penetrating through the intersection during assembly of the panel. Additionally, with reference to FIG. 4, spacers 44 may also be placed on the top intersections of adjacent glass blocks if desired.

Figure 5:
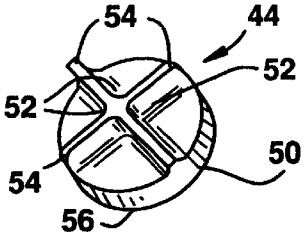
FIG. 5 is a top, perspective view of a spacer as used in the practice of the present invention.
Figure 5A:
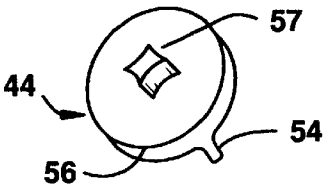
FIG. 5*a* is a bottom, perspective view of the spacer of FIG. 5.

A more detailed view of spacer 44 is shown with reference to FIGS. 5 and 5*a*. As shown in FIG. 5, spacers 44 include a base member 50 and on its upper surface, four concave side surfaces 52 with fins 54 extending from the intersection of side surfaces 52 to the perimeter of base member 56. A single stem 57 is provided on the lower surface as shown in FIG. 5*a*. Stem 57 is shown as substantially square (e.g. a four point star) in longitudinal cross section. By aligning the points of the square (or star) appropriately, with fins 54 on the opposite surface of spacer 44 and by making the sides of the square just slightly smaller in length than the width of groove 40, spacers 44 when placed in groove 40 may be slid there along and automatically hold blocks 10 in their proper spaced alignment during the sealing process with the adhesive.

With reference to FIGS. 2 and 5, side surfaces 52 of spacers 44 are constructed so as to receive a respective curved comer surface of a glass block 10. Side surfaces 52 may, if desired be somewhat concave if desired to accommodate the curvature in the corners of blocks 10. This is not necessary, however, and spacers 54 generally triangular or rectangular cross sectional in shape have been formed adequate for the intended purpose. The spacers may be made from a plastic material and should be relatively inexpensive to manufacture. Spacers 44, of course, are merely used to align blocks 10 during manufacture, and do not become integral with the panel. As such, they may be re-used during subsequent processing. As can be seen the elimination of the integral spacers heretofore employed in the art, as described above, results in a decrease in costs, as well as a more structurally sound and aesthetically pleasing panel as a resultant of this invention. Once glass blocks 10 are properly spaced on spacing rack 20, they may now be sealed by moving manifolds 26, 26*a*.

The structure of moving manifolds 26, 26*a* will now be described in more detail. With reference to FIGS. 1 and 6, moving manifolds 26, 26*a* are supported by and travel on a pair of manifold support rods 70, which are disposed along opposite ends of manifolds 26, 26*a*. In turn, manifold support rods 70 are secured between a vertical end member 23 of support frame 22 and an interfacing member 27. Manifold support rods 70 are placed such that they permit movement of moving manifolds 26, 26*a* from vertical end member 23 to interfacing member 27.

Moving manifolds 26, 26*a* are generally rectangular in shape and each has the appearance of a vertical wall. A plurality of feed holes (not shown) are disposed on manifolds 26 which receive sealant via feed lines 31*a* from supply feed 31. In certain preferred embodiments of this invention, as here illustrated, there are five pairs of feed holes on each manifold 26 (and the same on manifold 26*a*, not shown). Each pair of feed holes is disposed vertically. Similarly, five pairs of threaded shafts (not shown) are disposed at the exit of the feed holes on the surface of the manifold closest to spacing rack 20. Each pair of vertically disposed threaded shafts engages and secures a feed tube device F.

In operation, moving manifolds 26, 26*a* receive sealant from supply feed 31 and dispense the sealant (preferably silicone) through a plurality of feed tube devices F. Moving manifolds 26, 26*a* move between vertical end member 23 of support frame 22 and spacing rack 20. Each moving manifold 26, 26*a* is driven by a main drive screw 84. Main drive screw 84 operates to push and pull manifolds 26, 26*a* and is conventionally powered by an air or hydraulic mechanism, or the like. The amount of sealant dispensed from supply feed 31 to manifolds 26, 26*a* is controlled by a metering device 80. Each feed tube device F has a metering device 80 associated with it.

Figure 3:
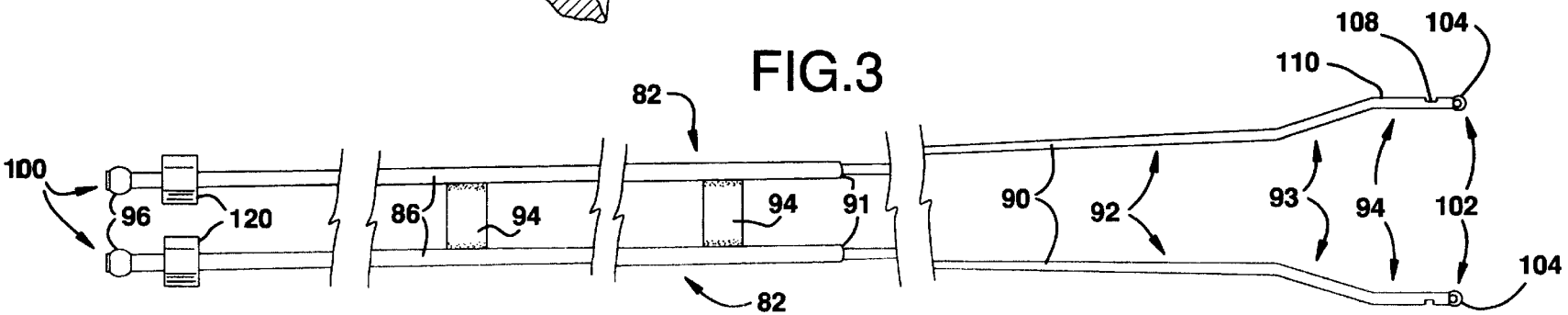
FIG. 3 is a side sectional view of the feed tubes of FIG. 2.

With reference now to FIG. 3, feed tube devices F will now be described in more detail. Each feed tube device F includes a pair of elongated feed tubes 82. Each tube includes a rigid tube member 86 and a flexible tube member 90 which is of a smaller diameter than the rigid tube member 86. In this embodiment, the rigid and flexible tube members 86 and 90 may be secured by brazing at their interface 91. Rigid tube members 86 are relatively straight and are secured in spaced parallel relationship by two rigid cross members 94, which are attached perpendicular to the longitudinal axis of rigid tube members 86. Rigid hollow tube members 86 include orifice entrances 96 at distal ends 100 for receiving a sealant to be applied to the glass blocks 10.

In contrast, flexible tube members 90 are not secured to one another, and are constructed to flare outwardly. Each flexible tube member 90 includes a first portion 92, substantially concentric with longitudinal axis of large tube 86 to which it is corrected. Thereafter, tube members 90 include a second angled outwardly flared portion 93, and a third parallel portion 94 terminating in distal end 102 whose mechanism is described below. While flared, it is to be seen that in the preferred embodiments of this invention all portions of both flexible tube members 90 lie in substantially the same horizontal plane, although this is not an absolute necessity so long as third portion 110 is properly located so as to distribute the adhesive at the proper location as further described below. First portions 92, like rigid tube members 86, are substantially parallel to each other.

Flexible tube members 90 each include a protruding end portion or tip 104 located at a distal end 102 of third portion 94. On each flexible tube member 90, located proximate to tip 104, is an aperture 108 disposed on opposing surfaces 110 of portions 94. Thus, apertures 108 are located such that they abut or face the upper and lower joint between adjacent blocks which are to receive the adhesive sealant material, and thus are located close to their respective tip 104. When feed tube devices F are moved into a joint cavity, tips 104 are compressed toward each other (as explained below) in a spring-like relation, exerting a spring force on upper and lower slots.

Thus, tips 104 act by their outward bias to compact and compress the sealant into the seams as the sealant is released from apertures 108 (see FIG. 4), much in the same way as a caulking tool. Thus, the sealant is automatically beaded and aesthetically formed between the seams as the compacting tips 104 move along the joint. The joints formed between adjacent blocks are preferably slightly smaller than the width of the tip 104. In this way, tip 104 tools sealant into the seam without completely extending through the seam, leaving an aesthetic, but highly uniform, compacted, and strongly adhered joint.

Attention is now directed to FIGS. 7 and 8 of the drawings. In these figures, there is illustrated alternative embodiments of tip 104 for compacting the sealant into the joints to be sealed. FIG. 7(*a*) illustrates the aforesaid tip 104. In this figure, tip 104 is essentially spherical. However, FIG. 8(*a*) illustrates that tip 104 preferably has two flat side portions 105, and a semi-spherical compacting head 106. The side portions 105 ride the inner surfaces of adjacent glass blocks 10 as compacting head 106 tools the sealant into the slot.

Alternatively, FIG. 7(*b*) illustrates a hook-like tip 107. Hook-like tip 107 has a rounded compacting head portion 108 with two fiat side portions 109, as illustrated with reference to FIG. 8(*b*). FIG. 7(*c*) illustrates another embodiment with a cube-like tip 110. Cube-like tip 110 includes two flat side portions 111 and a flat compacting head portion 112, as illustrated with reference to FIG. 8(*c*). FIG. 7(*d*) illustrates yet another embodiment with a triangular shaped tip 113. Triangular shaped tip 113 includes two flat angled portions 114 and a pointed compacting head portion 115 which compresses the sealant into the joint as shown with reference to FIG. 8(*d*). Finally, FIG. 7(*e*) illustrates another embodiment with a swivel-like tip 116. Swivel-like tip 116 includes two flat side portions 117 which ride the inner surfaces of adjoining blocks and a rounded compacting head portion 118 which compacts the sealant into the slot, as illustrated with reference to FIG. 8(*e*). The invention is not limited to the illustrated embodiments which are just given as examples.

The shape of flexible tube members 90 aid in the proper functioning of feed tube devices F. Because of the spring-like relation, the tips 104 have a natural tendency to want to spring through the intersection of four adjacent blocks, an incident which if allowed to occur could injure the tubes and/or simply stop the process of smooth movement of the tubes in the joint cavities. Third portion 94 prevents tips 104 from continuing its natural springing motion through the intersection. While the upper and lower joints are smaller than the width of tip 104, the intersection of all four blocks is larger. Thus, if feed tubes 82 were straight and did not extend out and then flatten, (i.e. resume a parallel posture) tip 104 would extend through the intersection, causing tip 104 to be wedged in the intersection. Portions 94, being of sufficient length prevent tips 104 from penetrating through the intersections of adjacent blocks 10, because as the feed tube devices F are withdrawn, portions 94 cross the intersection first, preventing tips 104 from springing through the intersections.

Rigid tube members 86 include threaded nuts 120 at their distal ends 100 for securement to the moving manifolds 26, 26*a*. With reference back to FIG. 1, threaded nuts 120 are screwed into complimentary threaded shafts (not shown) on moving manifolds 26 and 26*a*. In certain preferred embodiments, moving manifolds 26 and 26*a* include five pairs of threaded shafts which are vertically disposed so as to receive complimentary threaded nuts 120 of feed tubes devices F.

In operation, sealant is applied to glass blocks 10 by feed tube devices F in the following way: Feed tube devices F are affixed and disposed on moving manifolds 26, 26*a* which move as aforesaid thereby to cause feed tubes 82 to enter the appropriate joint cavity defined between adjacent blocks in the stack. With particular reference to FIG. 2, and in order to create the spring bias in the feed tubes, feed tube devices F must slide through respective vertical slotted portion 29 of guide bar 28. By establishing the appropriate height in slot 29, the distal ends 102 of tubes F are compressed to less than their normal spacing, thus allowing them to initially enter the joint cavity of the blocks. However, as tubes F move farther through and past slots 29 such that the flared portions 93 of tubes F engage slots 29, the compressed distal ends 102 separate until they rest, still outwardly biased in the block joint to be sealed. Retraction of tubes F creates the opposite effect, readying distal ends 102 for the next insertion when a new panel stack is presented to it for sealing. As a result of this compressive mechanism, after the sealant is dispensed, tips 104 compact the sealant into upper and lower joints between the blocks 10. The sealant is thus tooled to reach internally, while applying sealant to both top and the bottom interfaces at the same time. It is understood that the lengths of feed tube devices F may be such that they completely traverse spacing rack 20.

Having described the basic structure and function of panel assembly device P, the assembly operation will now be described in detail. In order to assemble a panel according to the present invention, glass blocks 10 must be properly positioned on panel assembly device P. This is accomplished by positioning spacers 44 into machined grooves 40 of spacing rack 20. Glass blocks 10 are then positioned on top of spacers 44. The glass blocks 10 and spacers 44 may be put onto spacing rack 20 by an unskilled worker, and should take just a few minutes. Spacers 44 may also be placed on the top interfaces of adjacent blocks, but in many operations this has been not found essential to accomplish. After glass blocks 10 are properly positioned, the operation of panel assembly device panel P will begin.

As described above, support frame 22 carries perpendicularly disposed moving manifolds 26, 26*a*. In their retracted position, tubes F are in the position shown in FIG. 2. As the manifolds move toward the block stack thereby to insert tubes F into the joint cavities, the tubes, due to the outward spring bias tend to follow the extremity of slots 29 such that as the tube ends 102 enter the cavity, flared portions 93 begin to contact the extremities of slots 29, commencing the separation of opposing distal ends 102. Continued movement of the manifolds causes the distal ends to separate until they contact and ride along the joint to be sealed (as shown in FIG. 4). On this expanded but still compressed and outwardly biased configuration, the tubes F are extended until they reach the furthest extremity of the furthest joint in the stack to be sealed. At this point the manifolds are retracted and the sealant is dispensed while the tips 104 compact and tool the sealant as shown in FIG. 4. (The manifolds 26 and 26*a* are operated, of course, alternatively, so as not to interfere with one another). When fully withdrawn the sealing operation is complete.

In the preferred embodiments of this invention, the sealant used is flexible and adheres naturally to the glass. This decreases the chance of the panel shattering as opposed to the use of mortar. The sealant used in these preferred embodiments is preferably silicone. The entire operation described above takes just a few minutes to perform, yet results in a more structurally sound panel than those constructed from prior art devices and methods.

After all abutting interfaces of glass blocks 10 are sealed, the panel may be conveyed off of spacing rack 20, while panel assembly device P is set up for another assembling process. After the panels are formed, spacers 44 may slightly adhere to the panel, but may be easily popped off and subsequently re-used.

Thus, the process and apparatus described offers great improvements over the prior art in that a stronger glass block may be constructed at a fraction of the cost. In addition, the time required to produce such panels is greatly reduced as well as quality control problems associated with constructing the panel on-site.

Once given the above disclosure, many other features, modifications and improvements will become apparent to the skilled artisan. Such features, modifications, and improvements are therefore to be considered a part of this invention, the scope of which is to be determined by the following claims:

What I claim is:

1. A method for assembling at least two glass blocks together, comprising the steps of:

providing a spacing rack;

positioning said glass blocks to be assembled together on said spacing rack in a spaced alignment such that opposing upper and lower seams are formed between upper and lower interfaces of adjacent blocks and a joint cavity is formed between the seams;

inserting into the joint cavity a sealant applicator;

dispensing a sealant through said sealant applicator simultaneously into the said upper and lower seams; and compressing said sealant into said upper and lower seams as said sealant is dispensed.

2. A method according to claim 1 which includes the further steps of:

providing grooves in said spacing rack;

providing spacers capable of aligning opposing corners of said blocks with respect to each other;

locating said spacers in said grooves; and placing said blocks into aligning association with said spacers thereby aligning said opposing corners of said blocks with respect to each other.

3. A method according to claim 1 wherein said sealant applicator includes at least one pair of spaced, elongated feed tubes each having a proximal end and a distal end, said each proximal end having a sealant dispensing opening, and said tubes having an aperture disposed proximate said distal ends;

wherein said step of inserting said sealant applicator into said joint cavity includes locating said apertures of said elongated tubes adjacent said upper and lower seams of said blocks; and wherein said method further includes the step of moving said tubes so as to move said apertures along said upper and lower seams simultaneously with said dispensing and compressing of said sealant in said seams.

4. A method according to claim 3 wherein said step of moving said tubes so as to move said apertures along said upper and lower seams includes withdrawing said elongated tubes from said joint cavity.

5. A method according to claims 1 or 3 wherein said step of compressing said sealant into said upper and lower seams as said sealant is dispensed includes biasing said distal ends of said tubes into compressing sealant engagement with a respective seam into which said sealant is being dispensed.

6. A method according to claim 5 wherein said step of biasing said distal ends of said tubes includes providing an initial spaced distance between said tubes in a said pair of tubes, such that the respective distal ends of said two spaced tubes is greater than the spaced distance between the opposing upper and lower seams formed between said upper and lower interfaces of said adjacent blocks; applying a space reducing force to said two spaced tubes to bias said tubes toward one another to a spaced distance less than the spaced distance between said opposing upper and lower seams; thereafter inserting said tubes into said joint cavity and thereafter removing said space reducing force from said pair of tubes and allowing said tubes to expand apart to the spaced distance between the said opposing upper and lower seams thereby bringing said distal ends of said tubes into sealant compressing engagement with said opposing upper and lower seams.

7. A method according to claim 1 wherein said sealant is silicone.

* * * * *